US006846216B1

(12) United States Patent
Balanchi

(10) Patent No.: US 6,846,216 B1
(45) Date of Patent: Jan. 25, 2005

(54) MAGNETIC CONSTRUCTION TOY

(76) Inventor: Steve H. Balanchi, 2217 El Sol Ave., Altadena, CA (US) 91001

( * ) Notice: Subject to any disclaimer, the term of this patent is extended or adjusted under 35 U.S.C. 154(b) by 0 days.

(21) Appl. No.: 10/632,654

(22) Filed: Aug. 1, 2003

(51) Int. Cl.[7] ..... A63H 33/04

(52) U.S. Cl. ..... 446/85; 446/92; 446/124; 273/157 R

(58) Field of Search ..... 446/119, 107, 446/122, 128, 124–126, 131–133, 137–139, 85, 87, 92, 102, 129; 273/156, 157 R, 456; 434/211–215, 190, 208, 277–279

(56) References Cited

U.S. PATENT DOCUMENTS

| | | | | | |
|---|---|---|---|---|---|
| 824,812 | A | * | 7/1906 | Pliimpton | 335/302 |
| 1,535,035 | A | | 4/1925 | Philipp | |
| 2,767,517 | A | * | 10/1956 | Hooper | 446/139 |
| 2,846,809 | A | | 8/1958 | Majenski | |
| 2,970,388 | A | * | 2/1961 | Yonkers | 434/277 |
| 2,983,071 | A | | 5/1961 | Oliver | |
| 3,556,526 | A | | 1/1971 | Currie | |
| 3,606,303 | A | | 9/1971 | Green | |
| 3,625,514 | A | * | 12/1971 | Haaland | 473/512 |
| 3,706,158 | A | | 12/1972 | Jensen | |
| 4,020,566 | A | * | 5/1977 | Dreiding | 434/278 |
| 4,030,209 | A | * | 6/1977 | Dreiding | 434/278 |
| 4,271,628 | A | | 6/1981 | Barlow | |

OTHER PUBLICATIONS

Pending U.S. Appl. No. 10/071,767 (allowed).

* cited by examiner

*Primary Examiner*—Bena B. Miller
(74) *Attorney, Agent, or Firm*—Frederick Gotha

(57) ABSTRACT

The invention relates to an improved geometric construction toy for building geometrical sculptures and consists of a multiplicity of magnetizable bodies and a multiplicity of construction members. The construction members have a plurality of connecting arms that have a first cantilevered end and a second portion that is integral with a hub portion and a permanent magnet in the first end for magnetically coupling with a magnetizable body. The hub portion has a geometrical center and the connecting arms have an axis of symmetry that passes through the geometrical center where the axes of symmetry are in the same plane and where the peripheral surface of a connecting arm intermediate the first end and second portion is symmetrical to the axis of symmetry in planes orthogonal to the axis.

18 Claims, 4 Drawing Sheets

MAGNETIC CONSTRUCTION TOY

FIELD OF THE INVENTION

This invention relates to a magnetic construction toy for building geometrical structures utilizing spherical magnetizable bodies and construction members having a central hub and a multiplicity of connecting members extending radially from the hub cantileverly where each connecting member's free end contains a permanent magnet.

BACKGROUND OF THE INVENTION

Magnetic toy construction elements which, when assembled with other construction elements to build various structures that are held together magnetically to form a geometrical structure, typically consist of connecting arms containing magnets at the extremities of the arm. The connecting arms generally engage a spherical magnetizable member which permits the connecting arm to magnetically couple with a magnetizable body to form the building blocks for the geometrical construction. In building a three dimensional construction utilizing toy construction elements, it is desirable to have construction elements that have a simple design yet are strong and durable in construction and challenge the builder's imagination in the same way as a puzzle to create unusual geometrical shapes. Construction elements are disclosed in the prior art, however, elements having a multiplicity of connecting arms extending integrally from a common hub that are spaced in equal angular increments, radially equidistant and in the same plane, provide a construction member that allows the toy to consist of fewer parts, less expensive to produce, yet providing a creative challenge to create a geometrical sculpture.

It is therefore desirable to have construction elements which are easily assembled into a geometrical sculpture that will be sufficiently rigid and retain its structural integrity after being assembled. An object of this invention is to provide a magnetic construction toy having construction elements that have structural strength and simplicity of design so as to reduce the number of elements required to create a sculpture and thus provide a construction toy capable of being uniquely coupled in imaginative ways to create a geometric sculpture.

SUMMARY OF THE INVENTION

There is, therefore, provided according to the present invention, a magnetic construction toy having construction elements for building geometric sculptures where each construction element contains a multiplicity of connecting arms extending radially from a hub where the connecting arms are disposed at equal angular intervals; the free end of each connecting arm contains a permanent magnet for magnetically coupling with a magnetizable body which in turn couples with another construction element, magnetically, in construction of the geometrical sculpture.

The present invention is directed to an improved construction element for use in a geometric construction toy that consists of, in the preferred embodiment, a multiplicity of connecting arms having a first end and a second portion and an axis of symmetry extending between the first end and second portion. A permanent magnet is carried within each connecting arm adjacent the first end of the arm while the second portion of the connecting member is integrally associated with the hub portion; each of the axes of symmetry of the connecting members lies in the same plane and are angularly displaced an equal number of degrees from each other. Each axis of symmetry extends radially from the geometrical center of the hub; the connecting arm associated with an axis of symmetry has a peripheral surface that is radially symmetric to the axis of symmetry in planes that are orthogonal to the axis of symmetry intermediate the first end and the second portion. The peripheral surface may also be a surface of revolution with respect to the axis of symmetry. A magnetizable body capable of magnetically coupling with the first end of a connecting arm of the construction member permits a multiplicity of connecting arms from other construction members to magnetically couple with the magnetizable body. Thus, by utilizing a multiplicity of magnetizable bodies the player can create different types of geometrical sculptures.

In one embodiment of the invention, the construction member has four connecting arms, each arm having a varying cylindrical cross-sectional shape that is radially symmetrical to the axis of symmetry extending intermediate the first end and second portion of the connecting member. Each axis of symmetry is in the same plane and angularly displaced ninety degrees from an adjoining axis of symmetry. The second portions of the connecting arms are integrally carried by the hub portion such that the axis of symmetry extends radially from the geometrical center of the hub. A permanent magnet is carried within each connecting arm adjacent the first end, where each first end is equidistant from the geometrical center of the hub portion. A magnetizable member preferably having a spherical shape, may couple with a first end of a connecting arm in the creation of a geometrical sculpture. Each connecting arm has a peripheral surface that is radially symmetrical to the axis of symmetry in planes orthogonal to the axis of symmetry intermediate the first end and second portion of the connecting arm. The peripheral surface may be a surface of revolution with respect to the axis of symmetry intermediate the first end and second portion of the connecting arm.

In yet another embodiment of the invention, the construction member has three connecting arms, each arm having a cylindrical shape that is radially symmetrical to the axis of symmetry extending intermediate the first end and second portion of the connecting member. Each axis of symmetry is in the same plane and angularly displaced one hundred twenty degrees from an adjoining axis of symmetry. The connecting arms are integrally carried by the hub portion at the second portion and the connecting arm is cantilevered with the first end unsupported. The axis of symmetry extends radially from the hub. Each connecting arm has a peripheral surface that is radially symmetrical to the axis of symmetry in planes orthogonal to the axis of symmetry intermediate the first end and second portion of the connecting arm. The peripheral surface may be a surface of revolution with respect to the axis of symmetry intermediate the first end and second portion of the connecting arm. A permanent magnet is carried within each connecting arm adjacent to the first end opposite from the hub, where each first end is equidistant from the geometric center of the hub. A magnetizable member preferably having a spherical shape, may couple with a multiplicity of connecting first ends of connecting arms in the creation of a geometrical sculpture.

BRIEF DESCRIPTION OF THE DRAWINGS

These and other features and advantages will become appreciated as the same become better understood with reference to the following specification, claims and drawings wherein:

DETAILED DESCRIPTION

Figure 1:
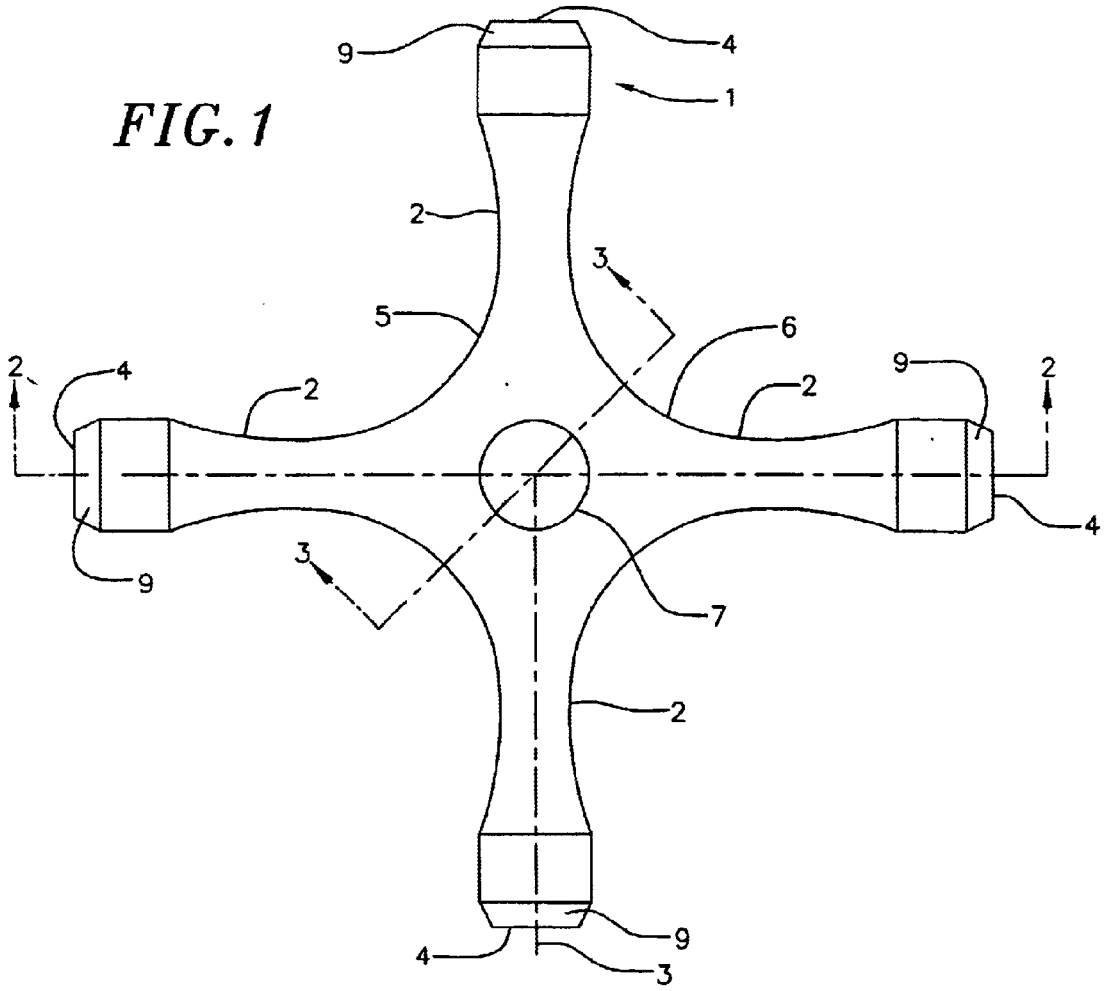
FIG. 1 is a top view of a construction member having four connecting arms extending from a hub portion of the member where each connecting arm has an axis of symmetry lying in the same plane.

FIG. 1 is a top view of the preferred embodiment of this invention. Construction member 1 is composed of a multiplicity of connecting arms 2 where each connecting arm 2 has an axis of symmetry 3, a first end 4, and a second portion 5 that is integral with hub portion 6. Hub portion 6 has a geometrical center that is the center of central opening 7. Central opening 7 extends through hub portion 6 as can more clearly be seen in 2.

Figure 2:
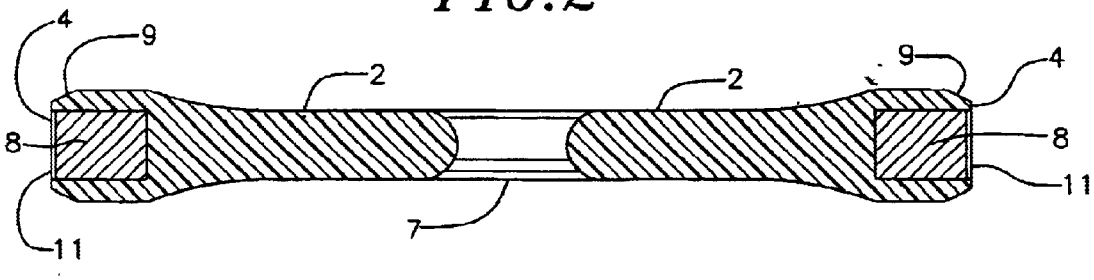
FIG. 2 is a cross sectional view along the line 2—2 as shown in FIG. 1.
Figure 3:
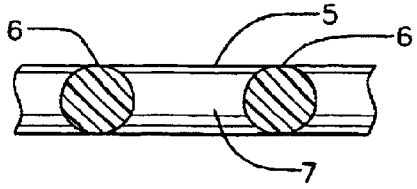
FIG. 3 is a cross sectional view along the line 3—3 as shown in FIG. 1.

Referring to FIG. 2 which is a cross section of the construction member taken along line 2—2 of FIG. 1, it can be seen that a permanent magnet 8 is captively held within first end 4 of the connecting arm. Preferably the construction member is made of a plastic material for cost effectiveness and ease of manufacture. Each connecting arm has an axis of symmetry 3 extending from the geometrical center of the central opening and has a peripheral surface that is symmetrical about its axis of symmetry 3 in any plane orthogonal to the symmetrical axis intermediate the first end 4 and second portion 5. In FIG. 2, it can be seen that at the first end 4 of the connecting arm, the connecting arm has an axially extending taper 9 that terminates at first end 4. An opening 11 in the first end 4 of connecting arm 2 forms a chamber that permits the permanent magnet 8 to be inserted within the first end of the connecting member so that the permanent magnet can be captively carried by the connecting arm at its first end. The peripheral surface of the connecting arm intermediate the first end and second portion may be a surface of revolution with respect to the axis of symmetry. The axes of symmetry are in the same plane and in the preferred embodiment are angular spaced ninety (ninety degrees) degrees from each other.

Figure 4:
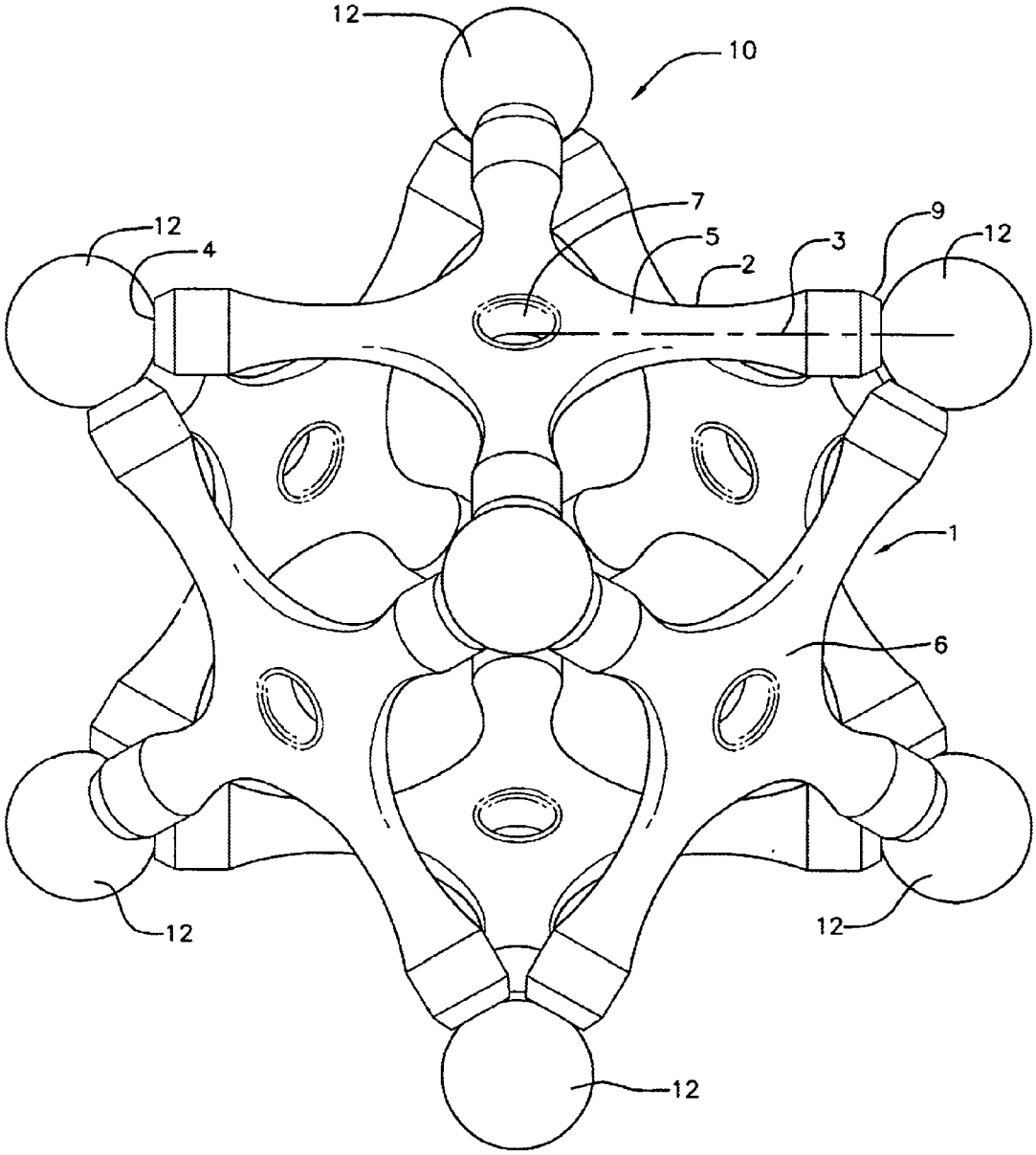
FIG. 4 is a perspective view of a geometrical sculpture constructed with construction members shown in FIGS. 1, 2 and 3 forming the geometrical sculpture through magnetic coupling with a magnetizable body.

In FIG. 4, a geometrical sculpture 10 is illustrated that consists of a multiplicity of construction members 1 which couple magnetically to magnetizable body 12. Although it is preferred that the first end 4 of connecting arm 2 contain a permanent magnet 8, in other embodiments, rather than a permanent magnet, a magnetizable material may be utilized that couples to a magnetic body such as the spherical body that is shown in FIG. 4.

Figure 5:
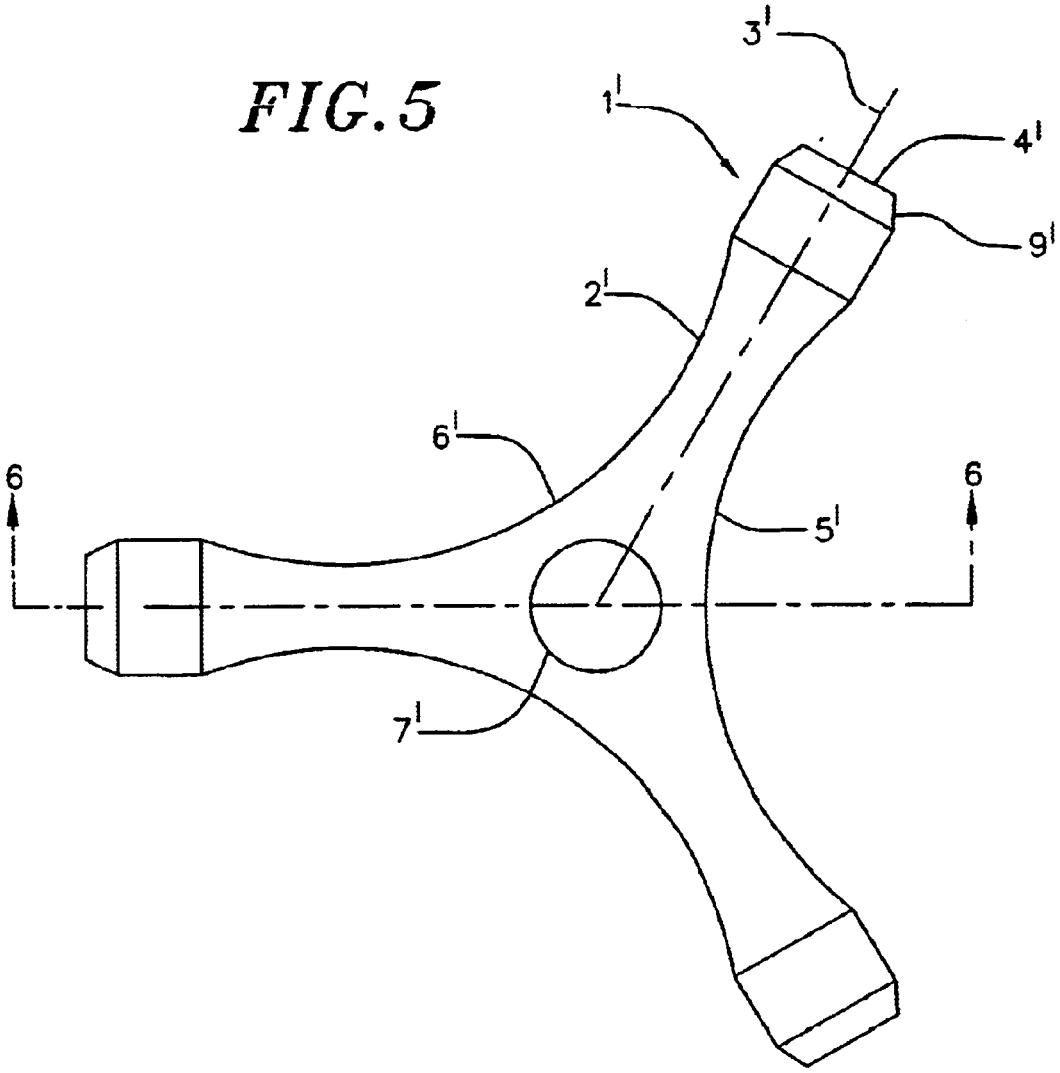
FIG. 5 is a top view of a construction member of an embodiment of this invention having three connecting arms, each arm having a symmetrical axis where the axes are angularly spaced one hundred twenty degrees and in the same plane.
Figure 6:
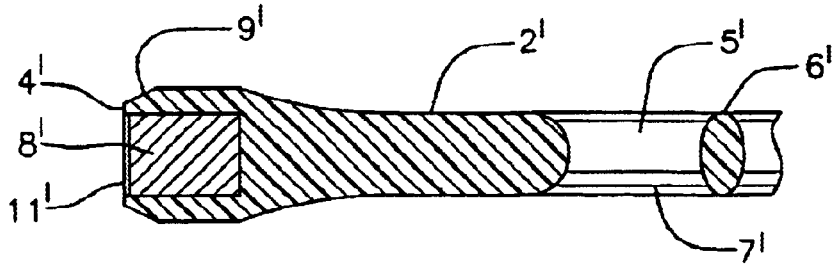
FIG. 6 is a cross sectional view taken along the line 6—6 shown in FIG. 5.
Figure 7:
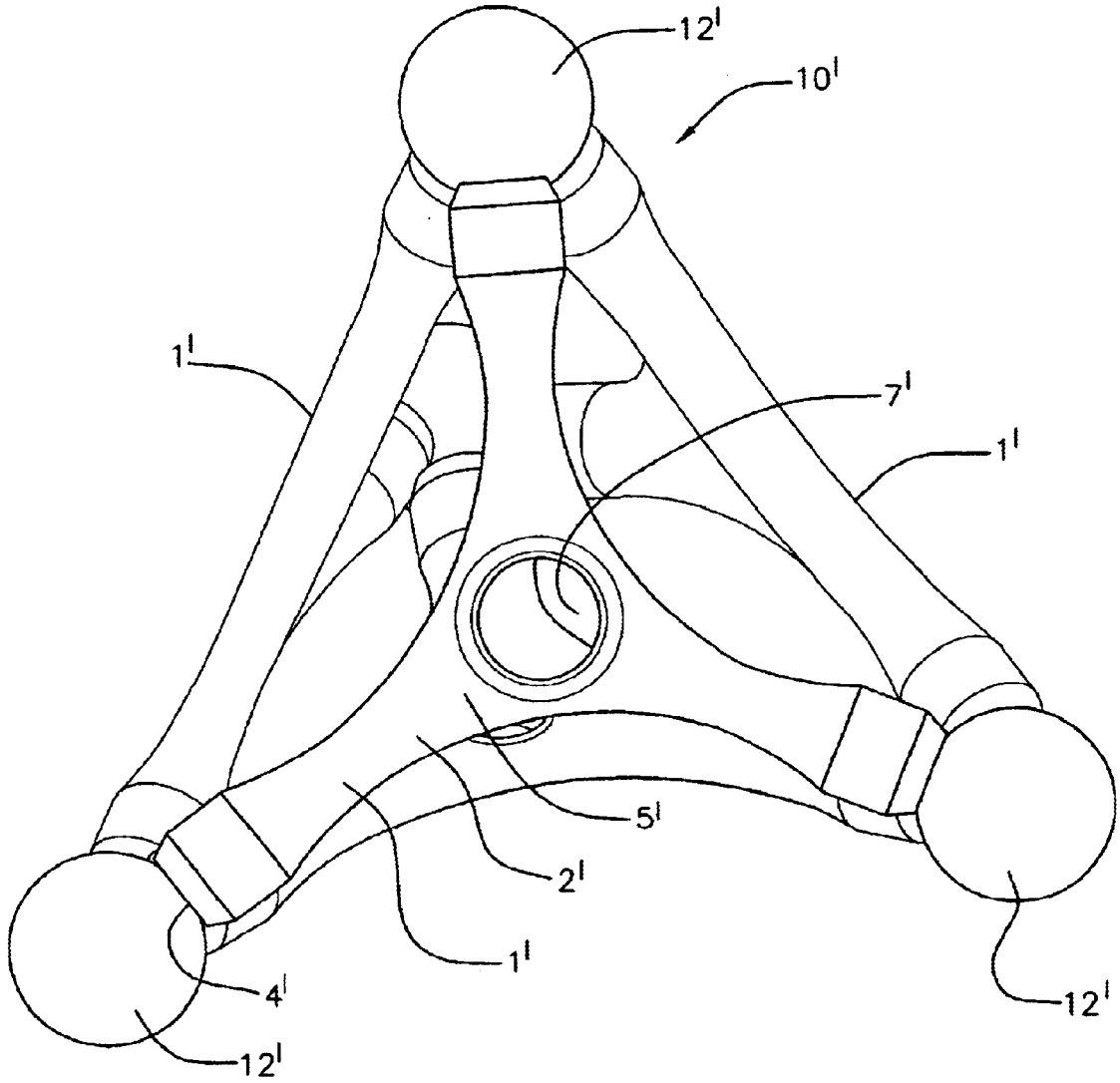
FIG. 7 is a perspective view of a geometrical sculpture constructed with construction members shown in FIGS. 5 and 6 forming the geometrical sculpture through magnetic coupling with a magnetizable body.

Another embodiment of this invention is illustrated in FIGS. 5, 6 and 7. FIG. 5 illustrates a construction member 1' having three connecting arms where each connecting arm has a peripheral surface that is symmetrical to symmetrical axis 3' in any plane orthogonal to symmetrical axis intermediate the first end 4' and second portion 5'; second portion 5' is integrally embodied in hub portion 6'. Each connecting arm 2' has an axis of symmetry 3' and each axis of symmetry is angularly displaced from an adjoining axis of symmetry by an angle of one hundred twenty degrees degrees. As above described in the embodiment containing four connecting arms, the embodiment of FIGS. 5, 6 and 7 of the construction member contains three axes of symmetry that are in the same plane and have a point of intersection at the geometrical center of hub portion 6'. By referring to FIG. 6, which is a cross section taken along the line 6—6 of FIG. 5, it can be seen that permanent magnet 8' is captively carried at first end 4' and is insertable into a chamber at first end 4' through opening 11'. As in the embodiment shown in FIGS. 1, 2, 3 and 4, the construction member as shown in FIG. 6 is preferably made of a plastic material for lightweight construction, and ease of manufacture. Likewise, the peripheral surface intermediate first end 4' and second portion 5' may be a surface of revolutions with respect to the axis of symmetry.

By referring to FIG. 7, a geometrical sculpture can be seen that is constructed of a multiplicity of construction members 1'. The permanent magnet 8' captively held in the first end of connecting arm 2' magnetically couples with magnetizable body 12' to permit the construction of geometrical sculpture 10'. Although not shown in this embodiment, magnetizable body 12' may be a permanent magnet while a magnetizable body may be utilized in first end 4' to permit the coupling of the connecting arm with the permanent magnet to form a geometrical sculpture.

While I have shown and described embodiments of a construction member for a magnetic construction toy, it is to be understood that the invention is subject to many modifications without departing from the scope and spirit of the claims as recited herein.

What is claimed is:

1. An improved magnetic construction toy comprising:

(a) a magnetizable body;

(b) a construction member for omnidirectional magnetic coupling with said magnetizable body comprising a hub portion having a geometrical center, a multiplicity of connecting arms extending radially from said geometrical center of said hub portion where each said connecting arm has an axis of symmetry extending radially from said geometrical center and where each said connecting arm has a first end and a second portion where said second portion is spaced axially opposite from said first end and is integrally associated with said hub portion, a permanent magnet captively carried adjacent said first end of each said connecting arm for omnidirectional magnetically coupling with said magnetizable body, where each said axis of symmetry is in the same plane and angularly spaced in equal angular increments.

2. The improved magnetic construction toy recited in claim 1 where each said connecting arm has a peripheral surface that is radially symmetrical with respect to said symmetrical axis in planes orthogonally intersecting said symmetrical axis intermediate said first end and said second portion of said connecting arm.

3. The improved magnetic construction toy recited in claim 1 where the angle between each said axis of symmetry is ninety degrees.

4. The improved magnetic construction toy recited in claim 1 where the angle between each said axis of symmetry is one hundred twenty degrees.

5. The improved magnetic construction toy recited in claim 2 where said magnetizable body is spherically shaped.

6. The improved magnetic construction toy recited in claim 2 where said first end is tapered.

7. The improved magnetic construction toy recited in claim 1 where each said connecting arm has a peripheral surface intermediate said second portion and said first end of said connecting arm that is a surface of revolution with respect to said symmetrical axis.

8. The improved magnetic construction toy recited in claim 7 where the angle between each said axis of symmetry is ninety degrees.

9. The improved magnetic construction toy recited in claim 7 where said axis of symmetry are displaced from each other in increments of one hundred twenty degrees.

10. The improved magnetic construction toy recited in claim 7 where said magnetizable body is spherically shaped.

11. An improved magnetic construction toy member for omnidirectionally coupling with an magnetizable body comprising:

(a) a hub portion having a geometrical center, (b) a multiplicity of connecting arms extending radially from said geometrical center of said hub portion where each said connecting arm has an axis of symmetry extending radially from said geometrical center and where each said connecting arm has a first end and a second portion where said second portion is spaced axially opposite from said first end and is integral with said hub portion, (c) a permanent magnet captively carried adjacent said first end of each said connecting arm for omnidirectional magnetic coupling with said magnetizable body, where each said axis of symmetry is in the same plane and angularly spaced in equal angular increments.

12. The improved magnetic construction toy member recited in claims 11 where each said connecting arm has a peripheral surface that is radially symmetrical with respect to said symmetrical axis in planes orthogonally intersecting said symmetrical axis intermediate said first end and said second portion of said connecting arm.

13. The improved magnetic construction toy member recited in claim 11 where the angle between each said axis of symmetry is ninety degrees.

14. The improved magnetic construction toy member recited in claim 11 where the angle between each said axis of symmetry is one hundred twenty degrees.

15. The improved magnetic construction toy member recited in claim 11 where said first end is tapered.

16. The improved magnetic construction toy member recited in claim 11 where each said connecting arm has a peripheral surface intermediate said second portion and said first end of said connecting arm that is a surface of revolution with respect to said symmetrical axis.

17. The improved magnetic construction toy member recited in claim 11 where the angle between each said axis of symmetry is ninety degrees.

18. The improved magnetic construction toy member recited in claim 11 where the angle between each said axis of symmetry is one hundred twenty degrees.

* * * * *